US008666238B2

(12) United States Patent
Wheeler et al.

(10) Patent No.: US 8,666,238 B2
(45) Date of Patent: Mar. 4, 2014

(54) FLUID PREHEATER

(75) Inventors: Jeff Wheeler, Battle Creek, MI (US); Gary Miller, Grand Blanc, MI (US)

(73) Assignee: Nexthermal Corporation, Battle Creek, MI (US)

( * ) Notice: Subject to any disclaimer, the term of this patent is extended or adjusted under 35 U.S.C. 154(b) by 550 days.

(21) Appl. No.: 13/054,286

(22) PCT Filed: Jul. 31, 2009

(86) PCT No.: PCT/US2009/052337

§ 371 (c)(1),
(2), (4) Date: Jan. 14, 2011

(87) PCT Pub. No.: WO2010/017095

PCT Pub. Date: Feb. 11, 2010

(65) Prior Publication Data

US 2011/0116776 A1 May 19, 2011

Related U.S. Application Data

(60) Provisional application No. 61/086,657, filed on Aug. 6, 2008.

(51) Int. Cl.
*F24H 1/18* (2006.01)

(52) U.S. Cl.
USPC ..... 392/450; 392/441; 392/449; 392/494

(58) Field of Classification Search
None
See application file for complete search history.

(56) References Cited

U.S. PATENT DOCUMENTS

| | | | | | |
|---|---|---|---|---|---|
| 961,937 | A * | 6/1910 | Cutler | 392/492 |
| 1,421,937 | A * | 7/1922 | Goldberg | 219/628 |
| 1,985,830 | A * | 12/1934 | Hynes | 392/492 |
| 3,270,182 | A * | 8/1966 | Hynes | 392/492 |
| 3,885,125 | A | 5/1975 | Palm et al. | |
| 3,996,997 | A * | 12/1976 | Regan et al. | 165/8 |
| 4,259,844 | A * | 4/1981 | Sarcia et al. | 62/6 |
| 4,869,232 | A | 9/1989 | Narang | |
| 5,265,318 | A * | 11/1993 | Shero | 29/447 |
| 5,694,515 | A * | 12/1997 | Goswami et al. | 392/480 |
| 5,727,118 | A * | 3/1998 | Roussel et al. | 392/494 |
| 5,872,891 | A * | 2/1999 | Son | 392/492 |
| 5,949,958 | A | 9/1999 | Naperkowski et al. | |
| 6,330,395 | B1 * | 12/2001 | Wu | 392/494 |
| 6,393,212 | B1 * | 5/2002 | Hutchinson | 392/491 |
| 6,422,305 | B2 * | 7/2002 | Jainek | 165/167 |

(Continued)

FOREIGN PATENT DOCUMENTS

JP 10-259955 A 9/1998

*Primary Examiner* — Thor Campbell
(74) *Attorney, Agent, or Firm* — McGarry Bair PC

(57) ABSTRACT

A fluid preheater (10) includes a body (12) having an interior wall (28) defining a chamber (42) and having an inlet (50) and an outlet (52). One or more heaters (18) are disposed in the wall (28), but not exposed to the chamber (42). The chamber (42) has one or more baffles that cause turbulence in the flow of fluid through the chamber (42) from the inlet (50) to the outlet (52) in order to increase the exposure of the fluid to heat from the heaters (18, 64).

16 Claims, 7 Drawing Sheets

(56) References Cited

U.S. PATENT DOCUMENTS

| | | | | |
|---|---|---|---|---|
| 6,701,069 | B1 * | 3/2004 | Cezayirli et al. | 392/490 |
| 7,106,957 | B2 * | 9/2006 | Abras et al. | 392/480 |
| 8,023,808 | B2 * | 9/2011 | Capraro | 392/465 |
| 8,028,664 | B2 * | 10/2011 | Kim | 122/481 |
| 8,180,207 | B2 * | 5/2012 | Shirai et al. | 392/491 |
| 8,463,117 | B2 * | 6/2013 | Yeung | 392/491 |
| 2004/0258403 | A1 * | 12/2004 | Abras et al. | 392/480 |
| 2012/0272927 | A1 * | 11/2012 | Jonsson | 122/19.1 |

* cited by examiner

FLUID PREHEATER

CROSS-REFERENCE TO RELATED APPLICATIONS

This application is a National Phase application of International Application No. PCT/US2009/052337, filed Jul. 31, 2009, which claims the benefit of U.S. Provisional Application No. 61/086,657, filed Aug. 6, 2008, both of which are incorporated herein by reference in their entirety.

BACKGROUND OF THE INVENTION

Field of the Invention

The invention relates to devices for preheating fluid.

SUMMARY OF THE INVENTION

In one aspect, a fluid preheater includes a body having an interior wall defining a chamber with an inlet and an outlet. The body has two or segments, each segment having an annular perimeter wall and an end wall with an opening in the end wall and an axial post extending from the end wall within the chamber. A center bore is in the axial post to receive a heater. Lobes extend into the chamber from the perimeter wall of each of the segments, each lobe having a bore. The bores are disposed closer to the chamber than to the exterior of the body. One or more heaters is in the center bore or the one of the bores in the lobes. The heater is not exposed to the chamber. There is at least one baffle in the chamber which will cause turbulence in the flow of fluid through the chamber from the inlet to the outlet to increase the exposure of the fluid to heat from the heater.

In another aspect, a fluid preheater includes a body having an interior wall defining a chamber with an inlet and an outlet. The body has two or segments, each segment having an annular perimeter wall and an end wall with an opening. Each segment has an annular groove on the annular edge of the perimeter wall away from the end wall, where a seal is located for sealing one segment to the next. One or more heaters is in the wall, wherein the heater is not exposed to the chamber. The heater is not exposed to the chamber. There is at least one baffle in the chamber which will cause turbulence in the flow of fluid through the chamber from the inlet to the outlet to increase the exposure of the fluid to heat from the heater.

DETAILED DESCRIPTION OF THE DRAWINGS

Figure 1:
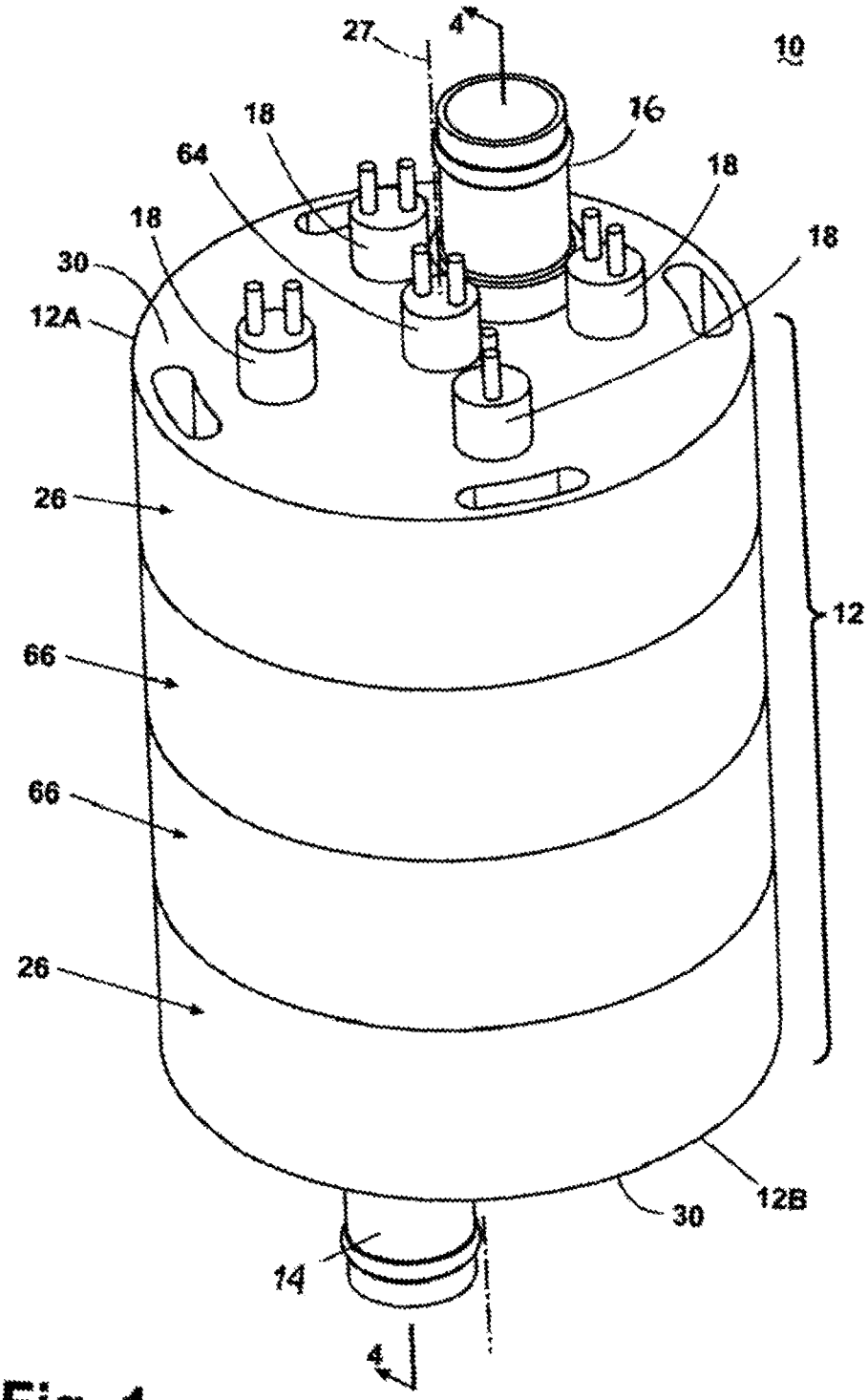
FIG. 1 is a perspective view of a fluid preheater according to a first embodiment of the invention.

Referring to the drawings, several embodiments of the invention are illustrated. In each, a fluid preheater 10 according to the invention comprises a body 12 fluidly coupled with an inlet tube 14 and an outlet tube 16. The body 12 raises the temperature of a fluid (not shown) that enters through the inlet tube 14 and exits the outlet tube 16 by causing the fluid to linger in the body, thereby increasing the time the fluid remains in contact with the body before it exits. A fluid preheater 10 according to the invention can heat any suitable fluid such as a coolant associated with an engine cooling system, or an isolated fluid supply.

Figure 2:
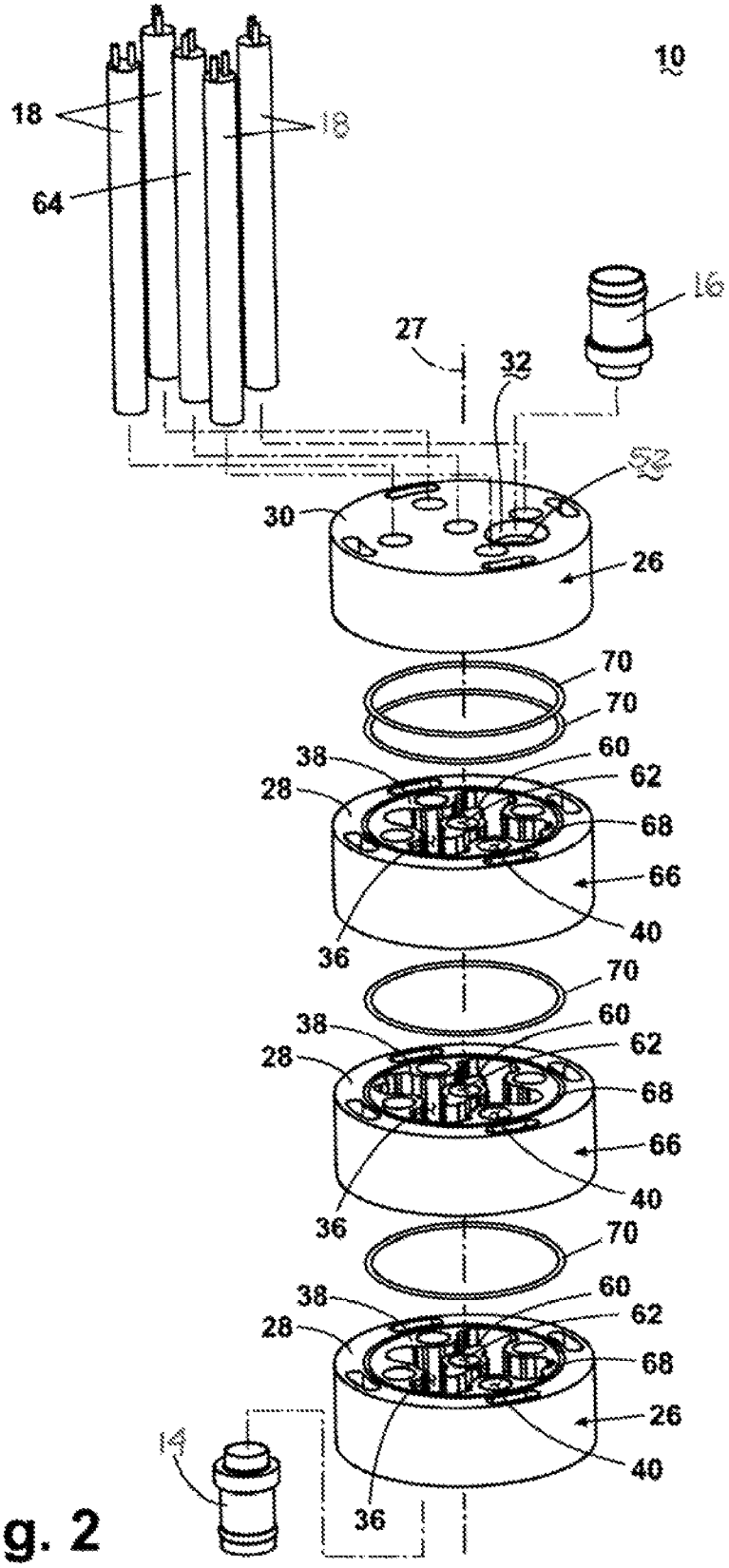
FIG. 2 is an exploded view of the fluid preheater illustrated in FIG. 1.

The body 12 defines an interior chamber 42 and comprises at least two body segments 26. Each body segment 26 is preferably cylindrical, having a longitudinal axis 27 and a circular cross-sectional configuration. The body segment 26 is thus defined in part by an annular perimeter wall 28, an end wall 30 closing one end but having an opening 32 offset from the longitudinal axis, and the other end being open. The perimeter wall 28 and the end wall 30 thus define an open cavity 36. Multiple body segments 26 can be stacked to form a body 12 as shown in FIGS. 1 and 2. Together, the multiple open cavities 36 of adjacent body segments 26 make up the interior chamber 42. The cavity 36 in each body segment (and thus the interior chamber 42) can be irregularly shaped, a direct result of the irregular thickness of the perimeter wall 28 show in the drawings. The body segments 26 can be cast of aluminum, although other suitable materials and methods of manufacture are possible.

Figure 3:
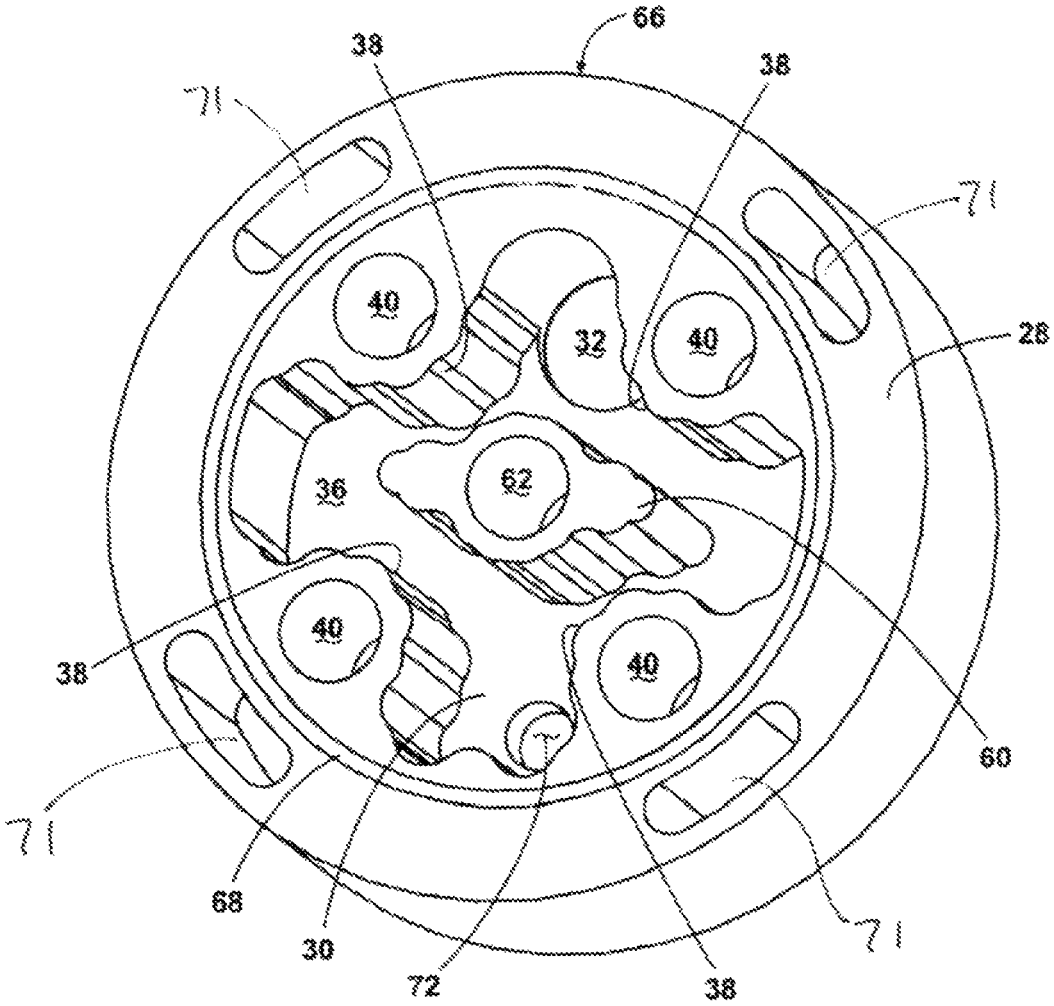
FIG. 3 is a perspective view of a segment of the fluid preheater illustrated in FIG. 1.

Referring now to FIG. 3, the body segment 26 further comprises a plurality of lobes 38 defined by the irregular thickness of the perimeter wall 28 and which extend from the perimeter wall 28 into the cavity 36. A bore 40 is located in each lobe 38 for receiving a cartridge heater 18 (FIG. 2). In the embodiment illustrated in FIG. 2, there are four cartridge heaters 18 shown installed in each of the four bores 40 in the perimeter wall 28. However, utilizing more or fewer lobes 38, bores 40, and cartridge heaters 18 is feasible. It should be noted that the bores 40 are disposed closer to the cavity 36 than to the exterior of the body 12. This promotes heat transfer to the fluid within the cavity 36 more so than the transfer of heat to the exterior of the body 12. Exemplary cartridge heaters include those available from Hotset Corporation of Battle Creek, Michigan. Wattage requirements of the cartridge heaters 18 will depend on specific application demands.

The body segment 26 also includes a center axial post 60 extending from the end wall 30 within the cavity 36 and having a center bore 62 aligned with the longitudinal axis 27. The center bore may be configured to receive a cartridge heater 64 (FIG. 2).

Referring again to FIGS. 1 and 2, the cartridge heaters 18, 64 can be installed through the bores 40, 60, which, preferably, have the same shape as the heaters 18, 64, such as the cylindrical shape illustrated in the drawings. The heaters 18, 64 can have electrical leads which can be coupled to a suitable power supply (not shown). Heating the cartridge heaters 18 will cause the perimeter wall 28 to heat through conduction. Fluid passing through the interior chamber 42 absorbs heat from the perimeter wall 28 by various heat transfer mechanisms, including radiation, convention and conduction. The lobes 38 on the interior of the perimeter wall 28 increase the surface area of the interior chamber 42 perimeter, thereby facilitating heat transfer from the perimeter wall 28 to the fluid. Cartridge heater 64 is illustrated as penetrating the end wall 30 through the center bore 62 located in the center of the cavity 36 to provide additional heating of the fluid in the chamber 42. This cartridge heater 64 can be similarly coupled through electrical leads to the power supply. Further, cartridge heater 64 can be of a difference wattage than that of cartridge heaters 18 such that the fluid preheater 10 can optionally be operated at high or low power through selectable circuits. In other words, one might select only the cartridge heaters 18 or only the cartridge heater 64 or both. As well, it is within the scope of the invention to separately control each cartridge heater 18, 64 to more finely control the amount of heat transfer to the interior chamber 42. Other heating elements, such as coil heaters, tubular heaters, and the like can be substituted for or added to the cartridge heaters. As well, it is within the scope of the invention for a hot fluid to be directed through the bores 40 to heat the body 12.

The fluid preheater 10 comprises at least two body segments 26, both of which are identical. One or more additional body segments 26 can be utilized also, providing a modular assembly, and adding heating capacity in preselected increments. The additional body segments 26, defined as interior body segments 66, are sandwiched between the two end segments 26. The two end body segments 26 are positioned in a clamshell arrangement, otherwise described as being in minor-image of one another. Multiple interior body segments 66 preferably face the same direction, which by default is also the same direction as one of the end segments 26. But it is apparent that the interior body segments 66 will face in the direction of one or the other end body segments 26. In the embodiment illustrated, four body segments 26, 66 are shown; however more or fewer segments are feasible, with a minimum requirement of two end body segments 26. The body segments 26 and 66 are generally identical in structure, but for purposes of clarity are numbered differently in this description depending on their location. The end walls of the interior body segments 66 serve as baffles to obstruct the flow of fluid as explained below.

Looking further at FIG. 3, the body segment 26, 66 further comprises an annular groove 68 located on the annular edge of the perimeter wall 28, away from the end wall 30. A seal 70 is positioned in the groove 68 and is adapted to seal one body segment 26, 66 to an adjacent one. The seal 70 can be any suitable seal, such as a well known rope seal or gasket, or the body segments 26, 66 can be sealed by a suitable adhesive. Further, each segment 26, 66 has slotted bores 71 near the exterior perimeter wall. When the segments are stacked, the slotted bores 71 will be in registry to enable a fastener to secure the segments to each other. A typical fastener can include a bolt and one or more nuts, a rivet, a clamp or a similar conventional device (none of which are shown in the drawings).

Figure 4:
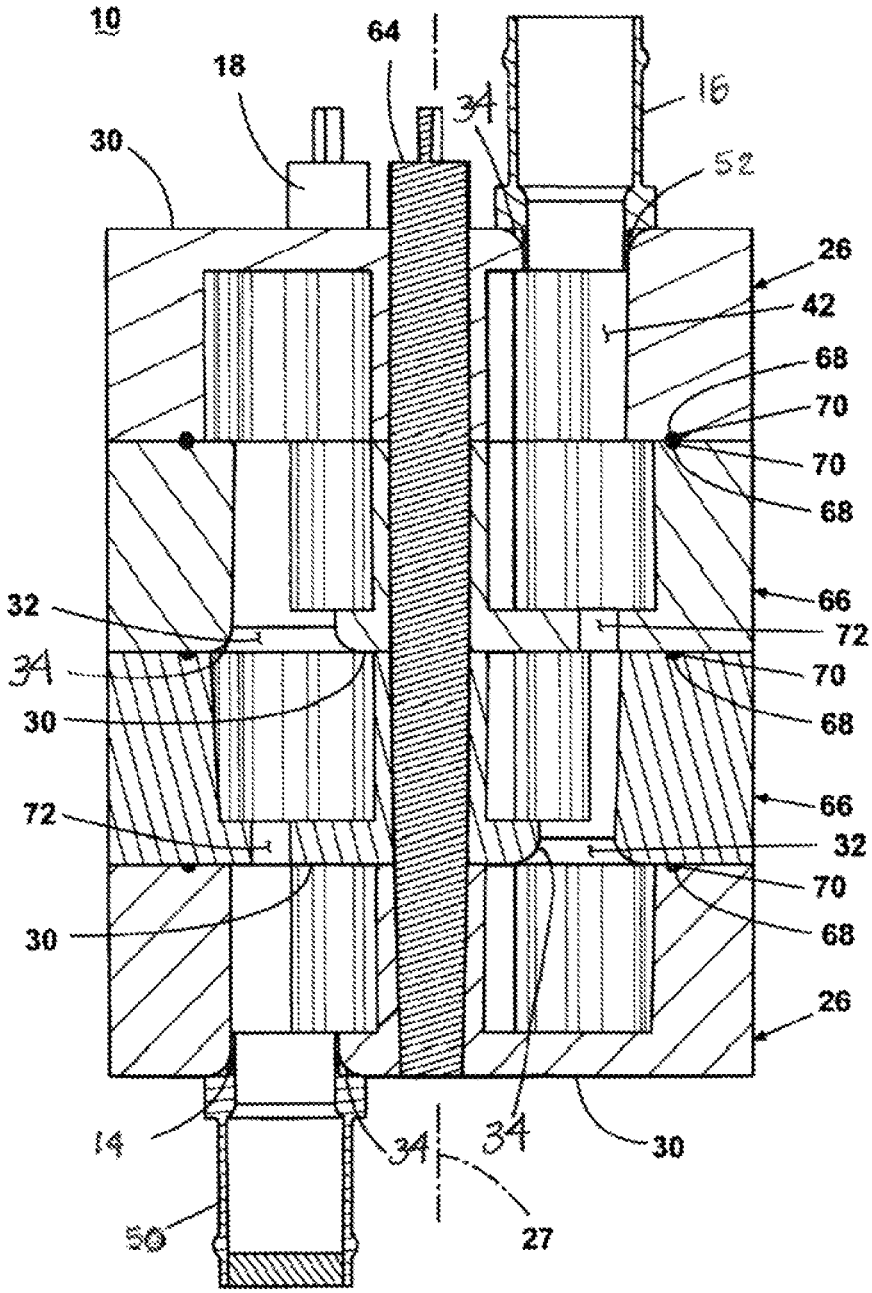
FIG. 4 is a cross-sectional view of the fluid preheater illustrated in FIG. 1 taken along line 4-4.

With the body segments 26, 66 thus disposed, the body 12 can be defined as having an inlet end 12A and an outlet end 12B. Further, end body segments 26 each include the end wall opening 32; the opening 32 on the inlet end 12A is defined as inlet opening 50 and the opening 32 on the outlet end 12B is defined as outlet opening 52 (FIG. 4). The inlet opening 50 can fluidly couple the interior chamber 42 with the inlet tube 14 and the outlet opening 52 can fluidly couple the interior chamber 42 with the outlet tube 16. Further, the transition between the end wall opening 32 and the exterior of the end wall 30 is defined by a radius 34. It has been found that the shape of the radius 34 is an important characteristic regarding the backpressure and backflow characteristics between cavities 36.

Referring to FIG. 4, the end body segments 26 and any interior segments 66 that make up the fluid preheater assembly 10 are oriented out of registry or phase with one another; meaning that the openings 32 in the end walls 30 of adjacent body segments 26, 66 are not in axial alignment. This is accomplished by positioning the adjacent body segments 26, 66 rotated relative to one another. In the embodiment illustrated, for example, because the body segments 26, 66 have four lobes 38, bores 40, and perimeter cartridge heaters 18, the segments 26, 66 are rotated in increments of 90° relative to the adjacent body segment 26, 66. By the nature of the above described mirror-image positioning, the two end body segments 26 are positioned with the inlet opening 50 and outlet opening 52 rotated 180° relative to one another. Any additional included interior body segments 66 are positioned with the end wall opening 32 rotated one of 90° or 180° relative to the adjacent body segment 26, 66. In this way, the inlet opening 50, interior end wall openings 32, and the outlet opening 52 are out of phase with the adjacent body segment 26, 66. It is feasible to include more or fewer lobes 38, bores 40, and cartridge heaters 18, which would respectively change the angle at which the body segments 26, 66 are rotated relative to one another. The purpose of the misalignment between adjacent body segments 26, 66 is to cause fluid to travel a greater distance within each cavity 36, thereby causing the fluid to linger in the interior chamber 42 longer than it would if passing directly from the inlet opening 50 to the outlet opening 52. This increases the time the fluid dwells in the interior cavity 42, thereby increasing the exposure to the heat provided by the cartridge heaters 18.

Referring again to FIG. 3, interior body segments 66, otherwise identical to body segments 26, can also include a weep hole 72, which can be machined as a secondary operation. The weep hole 72 extends through the end wall 30 and is positioned 180° opposite the end wall opening 32. The weep hole 72 functions to allow a preset amount of fluid flow directly from one cavity 36 to the next adjacent cavity 36. This allows a "high speed front" to form which causes the main fluid volume to be restricted before it can cross to the next adjacent cavity 36. This results in the fluid turning relative to the motion of the front, remixing in the cavity 36 below the front within the cavity 36, thereby increasing the dwell time of the fluid in the cavity 36 and promoting the exposure to the heated surface. Further, the weep hole 72 can be calibrated for different fluid viscosities as needed through shape or size adjustment.

Figure 5:
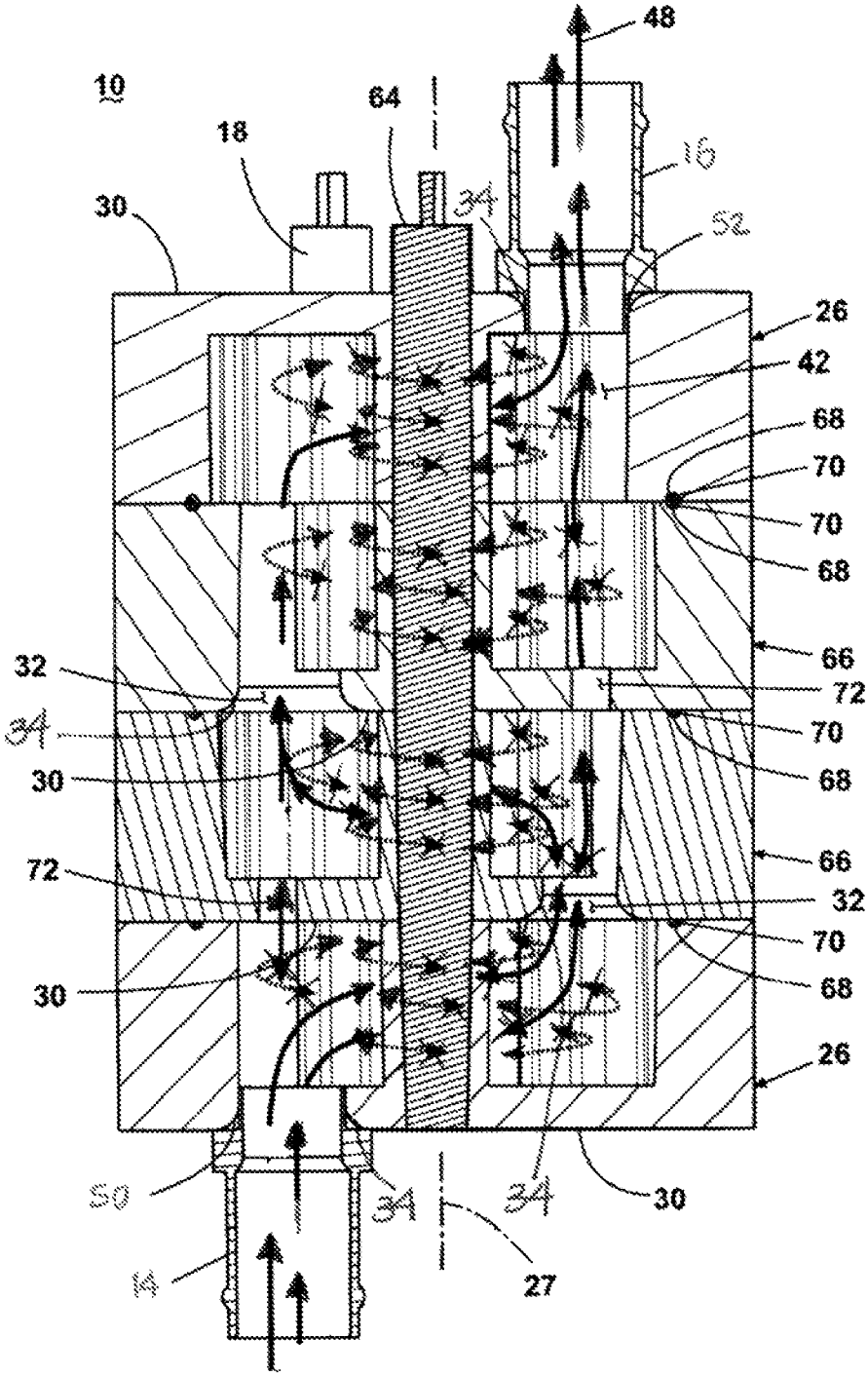
FIG. 5 is the cross-sectional view of the fluid preheater shown in FIG. 4, additionally illustrating a fluid flow path.

FIG. 5 illustrates the fluid flow through the interior chamber 42 from the inlet opening 50 to the outlet opening 52. Within the interior chamber 42, the fluid can travel a twisted, circuitous path 48 created by the configuration of the interior chamber 42, the offsetting of the end wall openings 32, the weep hole 72, and thermal gradients within the fluid. Additionally, the end walls 30 act as baffles to increase turbulence and further move the fluid through the circuitous path 48.

Figure 6:
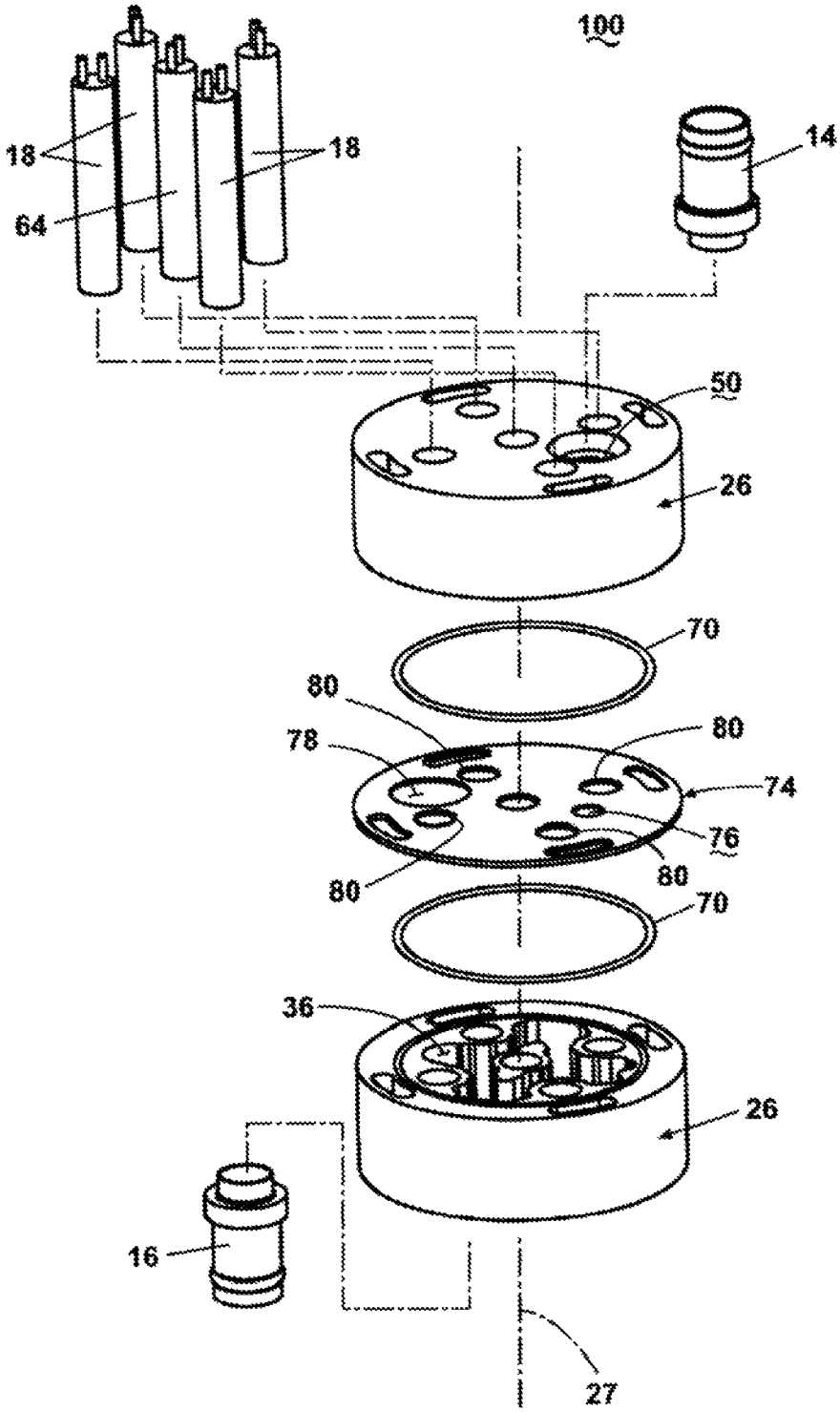
FIG. 6 is a perspective view of a fluid preheater according to a second embodiment of the invention.

Referring to FIG. 6, in an alternate embodiment where similar elements from the first embodiment are labeled with the same reference numerals, an alternate fluid preheater 100 is illustrated. The preheater 100 comprises two end body segments 26, an inlet opening 50, an outlet opening 52 (not shown), and can be fluidly coupled to an inlet tube 14 and an outlet tube 16. The preheater 100 further includes a baffle plate 74, defined by a flat metal disc. The baffle plate 74 includes bores 80 through which the cartridge heaters 18 can be inserted, a weep hole 76, and an opening 78, all similar to those located on the end wall 30 of the segment 26. The baffle plate 74 is sandwiched between the two oppositely facing end body segments 26; seals 70 are positioned between the baffle plate 74 and each end body segment 26 to seal the body segments 26 and baffle plate 74. The preheater 100 functions similarly to that of the first embodiment, the baffle plate 74 providing the means to cause the fluid to linger in the interior chamber 42 (FIG. 1) longer.

Figure 7:
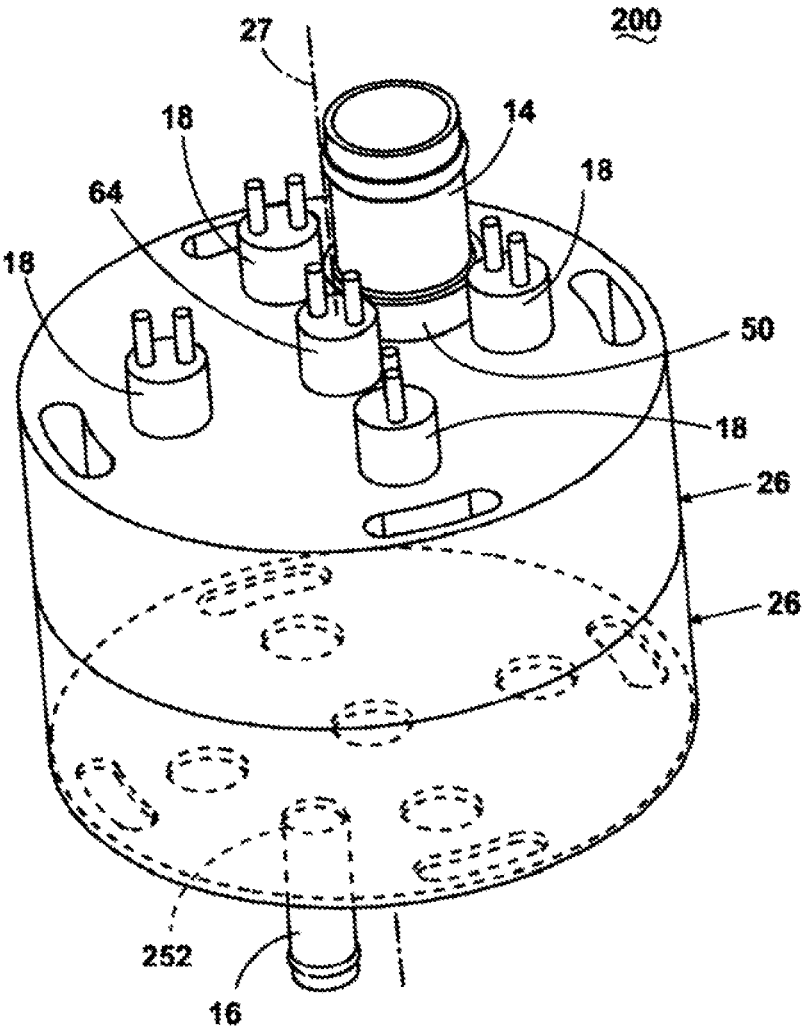
FIG. 7 is a perspective view of a fluid preheater according to a third embodiment of the invention.

Referring to FIG. 7, in an alternate embodiment where similar elements from the first embodiment are labeled with the same reference numerals, an alternate fluid preheater assembly 200 is illustrated. The preheater 200 comprises two end body segments 26, an inlet opening 50, an outlet opening 252, and can be fluidly coupled to an inlet tube 14 and an outlet tube 16. The end body segments 26 are assembled in a clamshell relationship, as described above. The preheater 200 further includes a means to cause fluid passing through the interior chamber 42 from the inlet opening 50 to the outlet opening 252 to linger in the interior chamber 42 longer than it would if passing directly from the inlet opening 50 to the outlet opening 252. One means to cause the fluid to linger in the interior chamber 42 is to size the outlet opening 252 smaller in diameter than the inlet opening 50. Another means to cause the fluid to linger in the interior chamber 42 is to include a body that is configured to create a cyclone motion of fluid within the interior chamber 42. This could be accomplished in a variety of methods well known in the art. One example of which is to configure the lobes 38 on the perimeter wall 28 in such a way as to induce a cyclonic motion of the fluid as it passes through the cavities 36 and interior chamber 42. Any of these means will cause the fluid to travel a twisted, circuitous path, increasing the time the fluid dwells in the heating cavity 42, and thereby increasing the exposure to the heat provided by the cartridge heaters 18.

For example, in use, the inlet tube 14 can be coupled with a radiator or storage system and pump to thereby utilize coolant in the fluid preheater 10, 100, 200. The outlet tube 16 can be coupled with a device for which heating is desired, such as a water jacket, reservoir, and the like, surrounding a battery. Flow of heated fluid from the preheater 10, 100, 200 through the heating device could then heat the battery. The cartridge heaters 18, 64 can be controlled through a thermal sensor and suitable control circuitry, such as a microprocessor-based controller, to heat the fluid to a selected temperature appropriate for heating of the fluid.

Alternative heat transfer systems can comprise redirected bypass systems for reheating the fluid, recirculation chamber designs, including independent circulation chambers, and flow slopes to create predictable high and low pressure paths and the/or reduce fluid velocities. Vortex principles can also be utilized to rotate the fluid to increase heated surface velocities, thereby increasing permissible watt densities before boiling occurs.

The fluid preheater is a high wattage heating assembly packaged in a small volume device which can be readily incorporated into a system requiring a heat source. The design of the preheater provides a very low pressure drop at both low and high flow rates. Increased flow and reduced pump sizing can be realized through utilizing fluid heat expansion techniques and optimizing chamber designs, including heated flow redirectors. The interior chamber can be surface coated to seal the surface of the chamber and reduce drag on the fluid.

Microsized transducers (not shown) mounted in the interior chamber 42 can be utilized to create a stand alone heater control system by modeling and creating a computation model using actual fluid variables to control and protect heaters and heating elements from failure. Variables to be measured can include incoming fluid temperature, outgoing fluid temperature, surface pressure in the interior chamber, and a flow rate.

Air chambers can be cast in the preheater housing to provide thermal barriers, thereby reducing the outside temperature of the housing. Ceramic epoxies, doped with fiberglass and Kevlar fibers or other insulation materials appropriate to the temperatures anticipated can reduce the heat transfer from the exterior of the housing, thereby providing increased efficiency of heat transfer to the interior chamber 42. Heating elements can be installed in the preheater housing by boring receptacles to lock the heating elements in place, and provide more surface area for heat transfer from the heating element to the housing. Heaters can also be cast into the housing, or can be configured to be replaceable.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A fluid preheater comprising:

a body having an interior wall defining a chamber and having an inlet and an outlet, the body having at least two segments;

each segment having an annular perimeter wall and an end wall with an opening in the end wall and an axial post extending from the end wall within the chamber with a center bore in the axial post to receive a heater;

lobes extending into the chamber from the perimeter wall of each of the at least two segments, each lobe having a bore wherein the bores are disposed closer to the chamber than to the exterior of the body;

at least one heater in one of the center bore or the bores in the lobes, wherein the at least one heater is not exposed to the chamber; and at least one baffle in the chamber;

whereby the at least one baffle will cause turbulence in the flow of fluid through the chamber from the inlet to the outlet to increase the exposure of the fluid to heat from the at least one heater.

2. A fluid preheater according to claim 1 wherein the at least two segments are identical.

3. A fluid preheater according to claim 1 wherein the at least one heater is a cartridge heater.

4. The fluid heater of claim 1 wherein the end wall forms the at least one baffle.

5. The fluid heater of claim 1 wherein the openings in the end walls of adjacent segments are not in registry.

6. The fluid heater of claim 1 wherein the body includes four segments and the end segments are disposed in a clamshell relationship and the interior segments are positioned like one of the end segments.

7. A fluid preheater according to claim 6 wherein at least one of the interior segments has an additional opening.

8. A fluid preheater comprising:

a body having an interior wall defining a chamber and having an inlet and an outlet, the body having at least two segments, each segment having an annular perimeter wall and an end wall with an opening;

wherein each segment has an annular groove on the annular edge of the perimeter wall away from the end wall, and wherein a seal is located for sealing one segment to the next;

at least one heater in the wall, wherein the heater is not exposed to the chamber; and at least one baffle in the chamber;

whereby the at least one baffle will cause turbulence in the flow of fluid through the chamber from the inlet to the outlet to increase the exposure of the fluid to heat from the at least one heater.

9. A fluid preheater according to claim 8 wherein the end wall and the annular perimeter wall define an open cavity that forms the chamber.

10. A fluid preheater according to claim 8 wherein each segment comprises multiple bores in the perimeter wall each to receive a heater.

11. A fluid preheater according to claim 8 wherein the openings in the end walls of adjacent segments are not in registry.

12. A fluid preheater according to claim 8 wherein the body includes four segments and the end segments are disposed in a clamshell relationship and the interior segments are positioned like one of the end segments.

13. A fluid preheater according to claim 12 wherein at least one of the interior segments has an additional opening.

14. The fluid heater of claim 8 wherein the end wall forms the at least one baffle.

15. The fluid heater of claim 8 wherein the at least two segments are identical.

16. A fluid preheater according to claim 8 wherein the at least one heater is a cartridge heater.

* * * * *